US011094176B2

(12) United States Patent
Lu et al.

(10) Patent No.: US 11,094,176 B2
(45) Date of Patent: Aug. 17, 2021

(54) STATE INDICATING DEVICES AND STATE INDICATING METHODS THEREOF

(71) Applicant: Quanta Computer Inc., Taoyuan (TW)

(72) Inventors: Wei-Ting Lu, Taoyuan (TW); Tai-Hsin Chu, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 16/774,235

(22) Filed: Jan. 28, 2020

(65) Prior Publication Data

US 2021/0104135 A1 Apr. 8, 2021

(51) Int. Cl.
*G08B 5/36* (2006.01)
*H05B 45/20* (2020.01)

(52) U.S. Cl.
CPC ..... *G08B 5/36* (2013.01); *H05B 45/20* (2020.01)

(58) Field of Classification Search
None
See application file for complete search history.

(56) References Cited

U.S. PATENT DOCUMENTS 7,276,861 B1 * 10/2007 Shteynberg ..... H05B 47/10 315/291
2005/0023991 A1 * 2/2005 Kemper ..... G01K 1/06 315/291
2010/0166035 A1 7/2010 Yoon
2014/0285354 A1 9/2014 Chen

FOREIGN PATENT DOCUMENTS

TW 583546 B 4/2004
TW 201024696 A 7/2010
TW 201502773 A 1/2015
TW M526201 U 7/2016

OTHER PUBLICATIONS

Chinese language office action dated Jan. 7, 2021, issued in application No. TW 108136136.

* cited by examiner

*Primary Examiner* — Curtis A Kuntz
*Assistant Examiner* — Shawna M Kingston
(74) *Attorney, Agent, or Firm* — McClure, Qualey & Rodack, LLP

(57) ABSTRACT

A state indicating device, which is adapted in an electronic device, includes a state detecting circuit, a controller, a driving circuit, and an LED device. The state detecting circuit is configured to detect an operation state of the electronic device to generate a detection signal. The controller generates a control signal according to the detection signal. The driving circuit generates a driving signal according to the control signal. The LED device displays an indication state according to the driving signal, in which the indication state is configured to indicate the operation state.

8 Claims, 4 Drawing Sheets

STATE INDICATING DEVICES AND STATE INDICATING METHODS THEREOF

CROSS REFERENCE TO RELATED APPLICATIONS

This Application claims priority of Taiwan Patent Application No. 108136136, filed on Oct. 5, 2019, the entirety of which is incorporated by reference herein.

BACKGROUND OF THE INVENTION

Field of the Invention

The disclosure relates generally to state indicating devices and state indicating methods thereof.

Description of the Related Art

With eSports getting much more popular, many products related to eSports have been launched. In order to pursue a distinctive look, players coincidently add lighting effects to eSports products to create visual effects on these products. However, most lighting effects are just configured to satisfy players with a visual experience, and they do not add any functionality, meaning that there are some unnecessary light sources added to electronic products. In order to make the light sources more meaningful, the light sources should be properly utilized.

BRIEF SUMMARY OF THE INVENTION

In an embodiment, a state indicating device, which is adapted in an electronic device, comprises a state detecting circuit, a controller, a driving circuit, and an LED device. The state detecting circuit is configured to detect an operation state of the electronic device to generate a detection signal. The controller generates a control signal according to the detection signal. The driving circuit generates a driving signal according to the control signal. The LED device displays an indication state according to the driving signal, wherein the indication state is configured to indicate the operation state.

According to an embodiment of the invention, when the electronic device operates in a first operation state, the LED device illuminates a first color. When the electronic device operates in a second operation state, the LED device illuminates a second color, wherein the first operation state and the second operation state are different and the first color and the second color are different.

According to an embodiment of the invention, when the electronic device operates in a first operation state, the LED device illuminates a first luminance. When the electronic device operates in a second operation state, the LED device illuminates a second luminance.

According to an embodiment of the invention, the state detecting circuit comprises a current detecting circuit. The current detecting circuit comprises a detection resistor, a converter, and a buffer circuit. The detection resistor receives a dissipative current to generate a voltage difference. The converter converts the voltage difference into a detection voltage. The buffer circuit is configured to buffer the detection voltage to improve the driving capability of the detection voltage. The controller calculates the dissipative current using the detection voltage and a lookup table.

According to another embodiment of the invention, the state detecting circuit comprises a temperature detecting circuit. The temperature detecting circuit comprises a current source, a bipolar junction transistor, and a buffer circuit. The current source generates a first current. The bipolar junction transistor comprises a collector terminal, a base terminal, and an emitter terminal, in which the base terminal is coupled to the collector terminal and receives the first current, and the emitter terminal is coupled to a ground. The bipolar junction transistor generates a detection voltage at the base terminal according to an operating temperature. The buffer circuit is configured to buffer the detection voltage to improve the driving capability of the detection voltage; in which the controller calculates the operating temperature using a lookup table and the detection voltage.

In another embodiment, a state indicating method comprises detecting an operation state of an electronic device; and displaying, on an LED device, an indication state according to the operation state.

According to an embodiment of the invention, the step of detecting the operation state of the electronic device further comprises: when the electronic device operates in a first operation state, illuminating a first color on the LED device; and when the electronic device operates in a second operation state, illuminating a second color on the LED device, wherein the first operation state and the second operation state are different, and the first color and the second color are different.

According to an embodiment of the invention, the step of displaying, on the LED device, the indication state according to the operation state further comprises: when the electronic device operates in a first operation state, illuminating a first luminance on the LED device; and when the electronic device operates in a second operation state, illuminating a second luminance on the LED device, wherein the first operation state and the second operation state are different, and the first color and the second color are different.

According to another embodiment of the invention, the step of displaying, on the LED device, the indication state according to the operation state further comprises: receiving, at a detection resistor, a dissipative current to generate a voltage difference; converting, using a converter, the voltage difference into a detection voltage; buffering, with the buffer circuit, the detection voltage to improve the driving capability of the detection voltage; and calculating the dissipative current using the detection voltage and a lookup table, wherein the dissipative current is the operation state.

According to another embodiment of the invention, the step of displaying, on the LED device, the indication state according to the operation state further comprises: generating a first current; receiving the first current using via a diode-connected bipolar junction transistor to generate a detection voltage; buffering the detection voltage with a buffer circuit to improve the driving capability of the detection voltage; and calculating the operating temperature using a lookup table and the detection voltage, wherein the operating temperature is the operation state.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
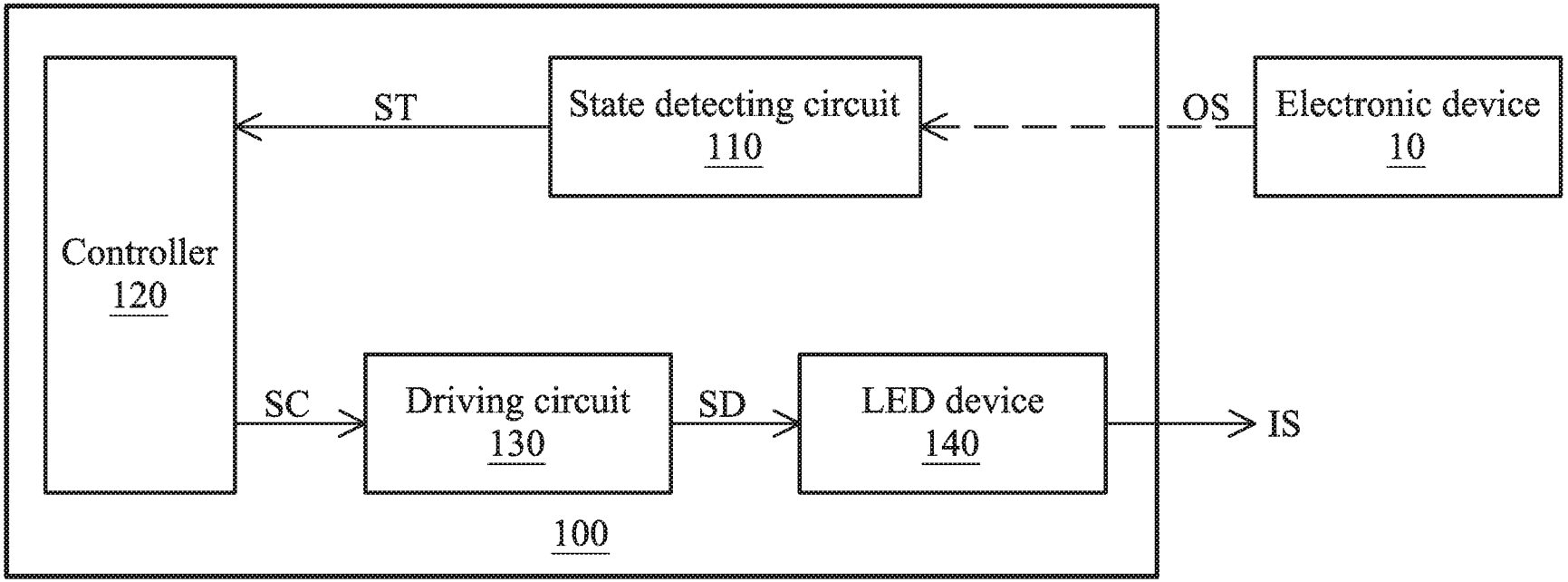
FIG. 1 is a block diagram of a state indicating device in accordance with an embodiment of the invention.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It should be understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of a state indicating device in accordance with an embodiment of the invention. As shown in FIG. 1, the state indicating device 100 includes a state detecting circuit 110, a controller 120, a driving circuit 130, and an LED device 140. The state detecting circuit 110 detects the operation state OS of the electronic device 10 to generate the detection signal ST.

The controller 120 receives the detection signal ST generated by the state detecting circuit 110 to acquire the operation state OS of the electronic device 10, and generates the control signal SC according to the detection signal ST. The driving circuit 131) generates the driving signal SD according to the control signal SC. The LED device 140 displays the indication state IS according to the driving signal SD, in which the indication state IS is configured to indicate the operation state OS of the electronic device 10. The indication state IS and the operation state OS will be described in the following paragraphs.

Figure 2:
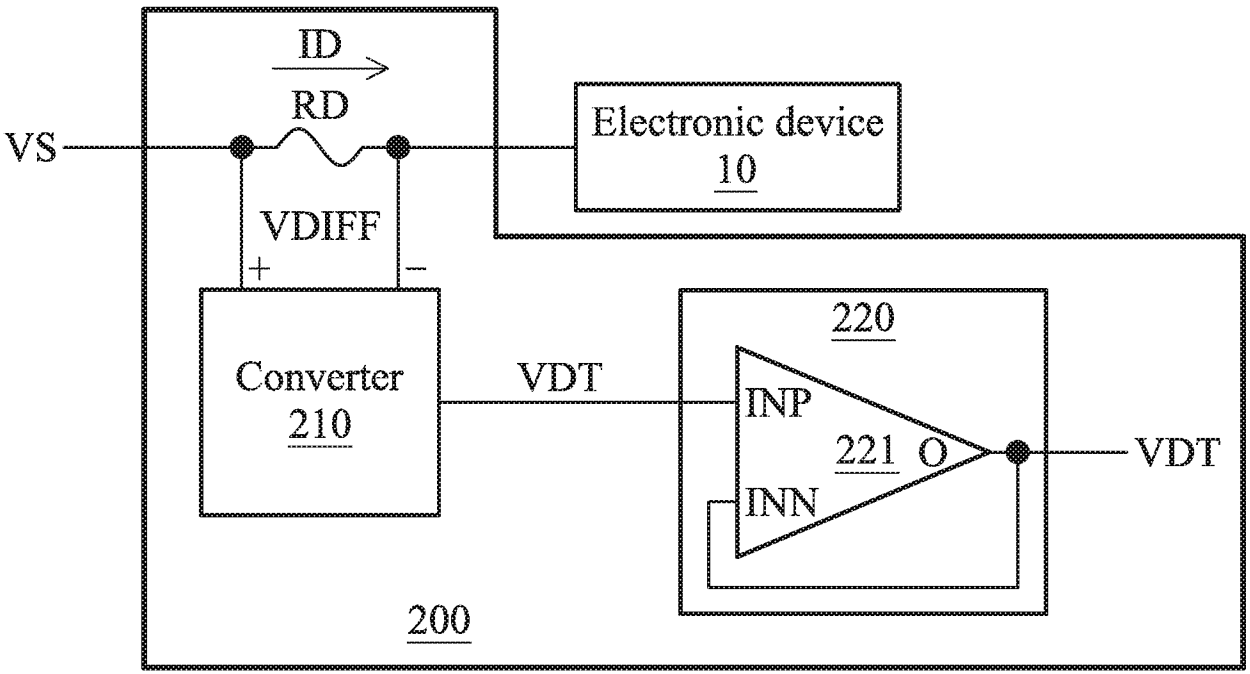
FIG. 2 is a block diagram of a current detecting circuit in accordance with an embodiment of the invention.

FIG. 2 is a block diagram of a current detecting circuit in accordance with an embodiment of the invention. According to an embodiment of the invention, the current detecting circuit 200 corresponds to the state detecting circuit 110 in FIG. 1. As shown in FIG. 2, the current detecting circuit 200 is configured to detect the dissipative current ID of the supply voltage supplied to the electronic device 10. According to an embodiment of the invention, the current detecting circuit 200 corresponds to the state detecting circuit 110 in FIG. 1.

According to an embodiment of the invention, the electronic device 10 is a desktop, and the current detecting circuit 200 is configured to detect the dissipative current of the external power source. According to another embodiment of the invention, the electronic device 10 is a mobile device, such as a laptop, and the current detecting circuit 200 is configured to detect the dissipative current of the external power source and the battery.

The current detecting circuit 200 includes a detection resistor RD, a converter 210, and a buffer circuit 220. The detection resistor RD receives the dissipative current ID of the supply voltage VS supplied to the electronic device 10 and generates a voltage difference VDIFF on both terminals of the detection resistor RD, the converter 210 converts the voltage difference VDIFF into a single-end detection voltage VDT. The buffer circuit 220 is configured to buffer the detection voltage VDT to improve the driving capability of the detection voltage VDT.

According to an embodiment of the invention, the detection voltage VDT corresponds to the detection signal ST in FIG. 1. According to an embodiment of the invention, when the controller 120 receives the detection voltage VDT, the controller 120 calculates the current value of the dissipative current ID using a lookup table stored in the controller 120 and the voltage value of the detection voltage VDT, and generates the control signal SC corresponding to the current value of the dissipative current ID so as to control the LED device 140 to display the indication state IS. According to another embodiment of the invention, the controller 120 further acquires the voltage value of the supply voltage VS, and calculates the power consumption of the electronic device 10 using the voltage value of the supply voltage VS and the current value of the dissipative current ID.

According to another embodiment of the invention, the controller 120 further includes an analog-to-digital converter (not shown in FIG. 1), in which the analog-to-digital converter is configured to convert the detection voltage VDT into a digital signal. The controller 120 generates the control signal SC corresponding to the digital signal generated by the analog-to-digital converter according to the digital signal so as to control the LED device 140 to display the indication state IS. Namely, since the detection voltage VDT indicates the dissipative current ID, the controller 120 can directly generate the control signal SC according to the detection voltage VDT, without calculating the dissipative current ID.

According to an embodiment of the invention, the controller 120 divides the dissipative current ID into several levels, in which each level of the dissipative current ID corresponds to a level of luminance illuminated on the LED device 140. For example, the dissipative current ID is divided into N levels, and the driving circuit 130 dims the LED device 140 with M levels of luminance, in which each level of dissipative current ID corresponds to a level of luminance illuminated on the LED device 140. Namely, when the dissipative current ID is increased, the controller generates the control signal SC so as to increase the luminance illuminated on the LED device 140. On the other hand, when the dissipative current ID is decreased, the controller 120 also generates the control signal SC so as to decrease the luminance illuminated on the LED device 140.

In other words, when the dissipative current ID of the electronic device 10 (i.e., the operation state OS) is a first current value, the indication state IS is a first luminance illuminated on the LED device 140; when the dissipative current ID of the electronic device 10 (i.e., the operation state OS) is a second current value, the indication state IS is a second luminance illuminated on the LED device 140. In addition, the first luminance is different from the second luminance.

According to another embodiment of the invention, the dissipative current ID has a maximum and a minimum. When the dissipative current ID is the minimum, the controller 120 controls the LED device 140 to illuminate a first color by using the control signal SC. When the dissipative current ID is the maximum, the controller 120 controls the LED device 140 to illuminate a second color by using the control signal SC, in which the first color and the second color are different.

For example, when the dissipative current ID is the minimum, the LED device 140 illuminates only blue light. With the dissipative current ID gradually increasing, the LED device 140 illuminates more red light and less blue light. When the dissipative current ID reaches the maximum, the LED device 140 illuminates only red light. Red light and blue light are illustrated herein, but not intended to be limited thereto.

In other words, when the dissipative current ID of the electronic device 10 (i.e., the operation state OS) is a first current value, the indication state IS is a first color illuminated on the LED device 140. When the dissipative current ID (i.e., the operation state OS) is a second current value, the indication state IS is a second color illuminated on the LED device 140. The first color and the second color are different.

As shown in FIG. 2, the buffer circuit 220 includes a differential—amplifier 221. The differential amplifier 221 includes an input positive terminal NP, an input negative terminal INN, and an output terminal O, in which the input positive terminal MP receives the detection voltage VDT and the output terminal O is coupled to the input negative terminal INN. In other words, the differential amplifier 221 is utilized as a unit-gain buffer such that the output terminal O of the differential amplifier 221 outputs the detection voltage VDT received by the input positive terminal INP.

Figure 3:
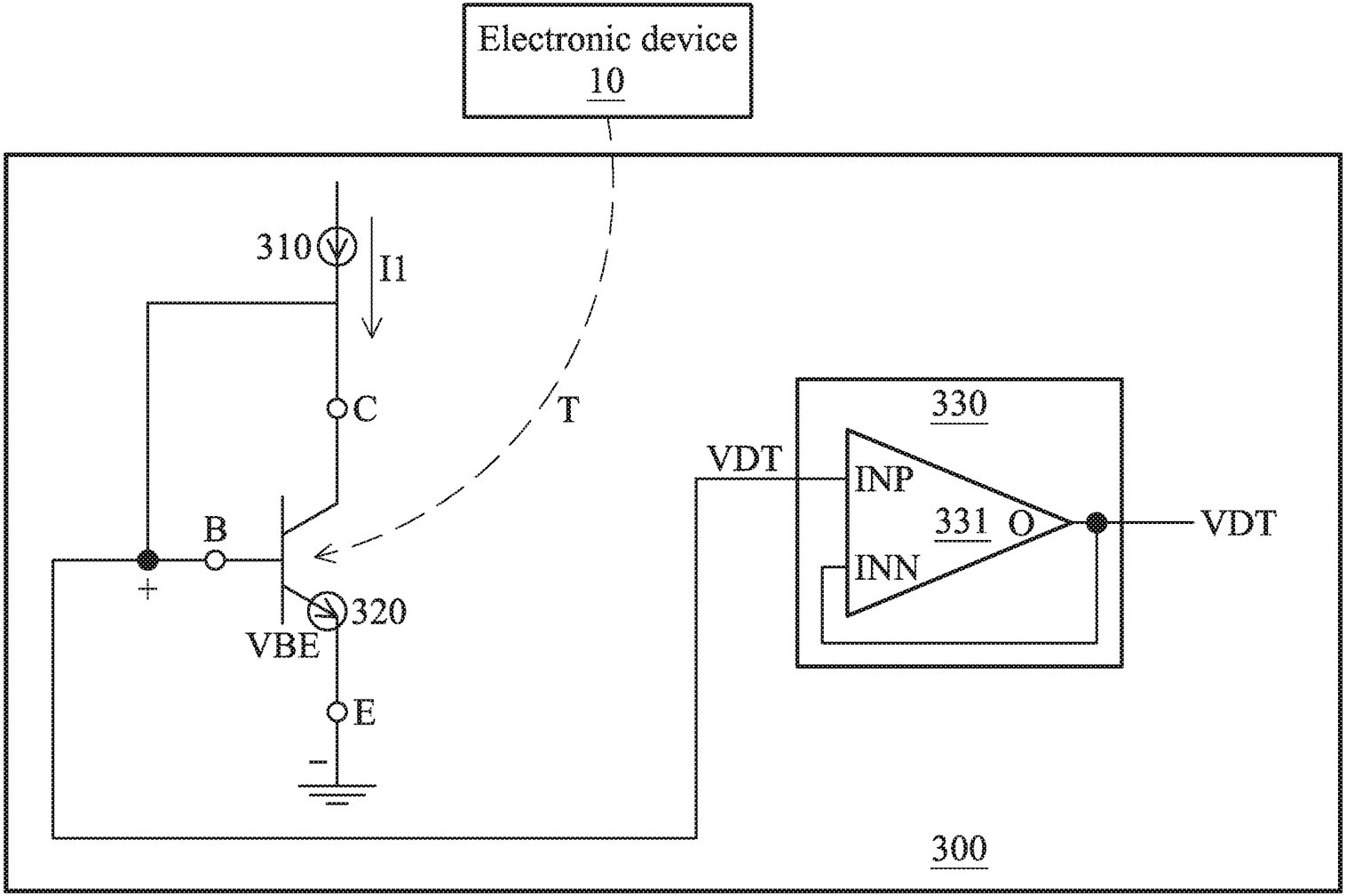
FIG. 3 is a block diagram of a temperature detecting circuit in accordance with an embodiment of the invention.

FIG. 3 is a block diagram of a temperature detecting circuit in accordance with an embodiment of the invention. According to an embodiment of the invention, the temperature detecting circuit 300 corresponds to the state detecting circuit 110 in FIG. 1.

As shown FIG. 3, the temperature detecting circuit 300 includes a current source 310, a bipolar junction transistor (BJT) 320, and a buffer circuit 330. The current source 311) generates a first current I1. The BJT 320 includes a collector terminal C, a base terminal B, and an emitter terminal E, in which the base terminal B is coupled to the collector terminal C and receives the first current I1, and the emitter terminal E is coupled to the ground. The BJT 320 generates the detection voltage VDT at the base terminal B according to the operating temperature T of the electronic device 10.

According to an embodiment of the invention, the electronic device 10 is a desktop. The temperature detecting circuit 300 is configured to detect the operating temperature T of the central processing unit (CPU). As shown in FIG. 3, the temperature detecting circuit 300 is configured to detect the operating temperature T of the electronic device 10. According to another embodiment of the invention, the electronic device 10 is a mobile device, such as laptop, and the temperature detecting circuit 300 is configured to detect the operating temperature T of the CPU and the battery.

According to an embodiment of the invention, since the voltage VBE across the base terminal B and the emitter terminal E of the BJT 320 is a linear function of temperature, the voltage VBE across the base terminal B and the emitter terminal E (i.e., the detection voltage VDT) can indicate the operating temperature T of the electronic device 10. According to other embodiments of the invention, the BJT 320 is illustrated as a diode-connected NPN transistor herein, and the BJT 320 may be a diode-connected PNP transistor as well.

As shown in FIG. 3, the buffer circuit 330 is configured to buffer the detection voltage VDT to improve the driving capability of the detection Voltage VDT. The buffer circuit 330 includes the differential amplifier 331. The differential amplifier 331 includes an input positive terminal INP, an input negative terminal INN, and an output terminal O, in which the input positive terminal INP receives the detection voltage VDT and the output terminal O is coupled to the input negative terminal INN. In other words, the differential amplifier 331 is utilized as a unit-gain buffer such that the output terminal O of the differential amplifier 331 outputs the detection voltage VDT received by the input positive terminal INP.

According to an embodiment of the invention, the detection voltage VDT corresponds to the detection signal ST in FIG. 1. According to an embodiment of the invention, when the controller 120 receives the detection voltage VDT, the controller 120 calculates the operating temperature using the lookup table stored in the controller 120 and the voltage value of the detection voltage VDT, and generates the control signal SD corresponding to the operating temperature T so as to control the LED device 140 to display the indication state IS.

According to another embodiment of the invention, the controller 120 further includes an analog-to-digital converter (not shown in FIG. 1), in which the analog-to-digital converter is configured to convert the detection voltage VDT into a digital signal. The controller 120 generates the control signal SC corresponding to the digital signal generated by the analog-to-digital converter according to the digital signal, so as to control the LED device 140 to display the indication state IS. Namely, since the detection voltage VDT indicates the operating temperature T, the controller 120 can directly generate the control signal SC according to the detection voltage VDT without calculating the operating temperature T.

According to an embodiment of the invention, the controller 120 divides the operating temperature T into several levels, in which each level of the operating temperature T corresponds to a level of luminance illuminated on the LED device 140. For example, the operating temperature T is divided into N levels, and the driving circuit 130 dims the LED device 140 to illuminate M levels of luminance, in which each level of the operating temperature T corresponds to a level of luminance illuminated on the LED device 140. Namely, when the operating temperature T rises, the controller 120 may generate the control signal SC so as to accordingly increase the luminance illuminated on the LED device 140. On the other hand, when the operating temperature T rises, the controller 120 may generate the control signal SC so as to accordingly lower the luminance illuminated on the LED device 140.

In other words, when the operating temperature T of the electronic device 10 (i.e., the operation state OS) is a first temperature, the indication state IS is a first luminance illuminated on the LED device 140. When the operating temperature T of the electronic device 10 (i.e., the operation state OS) is a second temperature, the indication state IS is a second luminance illuminated on the LED device 140, in which the first luminance and the second luminance are different.

According to another embodiment of the invention, the operating temperature T has a maximum and a minimum. When the operating temperature T is the minimum, the controller 120 controls the LED device 140 to illuminate a first color. When the operating temperature T is the maximum, the controller 120 controls the LED device 140 to illuminate a second color, in which the first color and the second color are different.

For example, when the operating temperature T is the minimum, the LED device 140 illuminates only blue light. With the operating temperature T rising, the LED device 140 illuminates more red light and less blue light. When the operating temperature T is the maximum, the LED device 140 illuminates only red light. Blue light and red light are illustrated herein, but not intended to be limited thereto.

In other words, when the operating temperature T of the electronic device 10 (i.e., the operation state OS) is a first temperature, the indication state IS is a first color illuminated on the LED device 140. When the operating temperature T of the electronic device 10 (i.e., the operation state OS) is the second temperature, the indication state IS is a second color, in which the first color and the second color are different.

Figure 4:
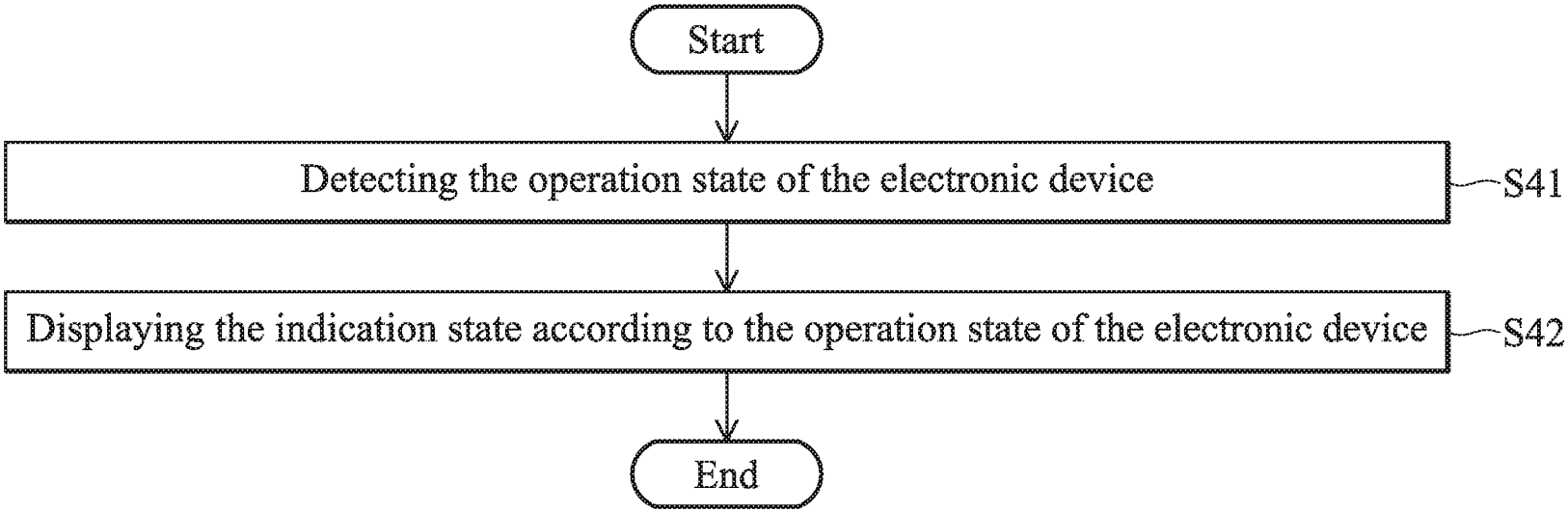
FIG. 4 is a flow chart of a state indicating method in accordance with an embodiment of the invention.

FIG. 4 is a flow chart of a state indicating method in accordance with an embodiment of the invention. The description of the state indicating method 400 in FIG. 1 will be accompanied with FIG. 1 in the following paragraphs, for the sake of detailed explanation.

First, the operation state of the electronic device 10 is detected by the state detecting circuit 110 (Step S41). According to an embodiment of the invention, the state detecting circuit 110. Which is the current detecting circuit 200 in FIG. 2, is configured to detect the dissipative current ID of the supply voltage VS supplied to the electronic device 10. According to an embodiment of the invention, the current detecting circuit 200 is configured to detect the dissipative current ID of the external power source. According to another embodiment of the invention, the current detecting circuit 200 is configured to detect the dissipative current ID of the battery.

According to another embodiment of the invention, the state detecting circuit 110 is the temperature detecting circuit 300. According to an embodiment of the invention, the temperature detecting circuit 300 is configured to detect the operating temperature T of the CPU. According to another embodiment of the invention, the temperature detecting circuit 300 is configured to detect the operating temperature T of the battery.

Then, the LED device 140 displays the indication state IS according to the operation state OS of the electronic device 10 (Step S42). According to an embodiment of the invention, when the state detecting circuit 110 is the current detecting circuit 200 in FIG. 2, the operation state OS of the electronic device 10 is the dissipative current ID. According to another embodiment of the invention, when the state detecting circuit 110 is the temperature detecting circuit 300 in FIG. 3, the operation state OS of the electronic device 10 is the operating temperature T.

According to an embodiment of the invention, when the operation state OS is a first operation state, the LED device 140 illuminates a first luminance. When the operation state OS is a second operation state, the LED device 140 illuminates a second luminance, in which the first operation state and the second operation state are different and the first luminance and the second luminance are different.

According to another embodiment of the invention, when the operation state OS is a first operation state, the LED device 140 illuminates a first color. When the operation state OS is a second operation state, the LED device 140 illuminates a second color, in which the first operation state and the second operation state are different and the first color and the second color are different.

In other words, the LED device 140 illuminates different luminance and/or different colors of light in response to the electronic device 10 operating in different operation state OS.

The state indicating device and the state indicating method provided herein make the light sources on products not only gorgeous but also allow them to indicate the state in which the system is operating. Therefore, the light sources on products have both an aesthetic and practical function.

While the invention has been described by way of example and in terms of preferred embodiment, it should be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A state indicating device adapted in an electronic device, comprising:

a state detecting circuit, configured to detect an operation state of the electronic device to generate a detection signal;

a controller, generating a control signal according to the detection signal;

a driving circuit, generating a driving signal according to the control signal; and an LED device, displaying an indication state according to the driving signal, wherein the indication state is configured to indicate the operation state, wherein the state detecting circuit comprises:

a current detecting circuit comprising:

a detection resistor, receiving a dissipative current to generate a voltage difference;

a converter, converting the voltage difference into a detection voltage; and a buffer circuit, configured to buffer the detection voltage to improve driving capability of the detection voltage, wherein the controller calculates the dissipative current using the detection voltage and a lookup table to generate the control signal.

2. The state indicating device of claim 1, wherein when the electronic device operates in a first operation state, the LED device illuminates a first color, wherein when the electronic device operates in a second operation state, the LED device illuminates a second color, wherein the first operation state and the second operation state are different and the first color and the second color are different.

3. The state indicating device of claim 1, wherein when the electronic device operates in a first operation state, the LED device illuminates a first luminance, wherein when the electronic device operates in a second operation state, the LED device illuminates a second luminance.

4. The state indicating device of claim 1, wherein the state detecting circuit comprises:

a temperature detecting circuit, comprising:

a current source, generating a first current;

a bipolar junction transistor, comprising a collector terminal, a base terminal, and an emitter terminal, wherein the base terminal is coupled to the collector terminal and receives the first current and the emitter terminal is coupled to a ground, wherein the bipolar junction transistor generates a detection voltage at the base terminal according to an operating temperature; and a buffer circuit, configured to buffer the detection voltage to improve the driving capability of the detection voltage, wherein the controller calculates the operating temperature using a lookup table and the detection voltage.

5. A state indicating method, comprising:

detecting an operation state of an electronic device; and displaying, on an LED device, an indication state according to the operation state, wherein the step of detecting the operation state of the electronic device further comprises:

receiving, at a detection resistor, a dissipative current to generate a voltage difference;

converting, using a converter, the voltage difference into a detection voltage;

buffering, with a buffer circuit, the detection voltage to improve the driving capability of the detection voltage; and calculating the dissipative current using the detection voltage and a lookup table, wherein the dissipative current is the operation state.

6. The state indicating method of claim 5, wherein the step of detecting the operation state of the electronic device further comprises:

when the electronic device operates in a first operation state, illuminating a first color on the LED device; and when the electronic device operates in a second operation state, illuminating a second color on the LED device, wherein the first operation state and the second operation state are different, and the first color and the second color are different.

7. The state indicating method of claim 5, wherein the step of displaying, on the LED device, the indication state according to the operation state further comprises:

when the electronic device operates in a first operation state, illuminating a first luminance on the LED device; and when the electronic device operates in a second operation state, illuminating a second luminance on the LED device, wherein the first operation state and the second operation state are different, and the first luminance and the second luminance are different.

8. The state indicating method of claim 5, wherein the step of detecting the operation state of the electronic device further comprises:

generating a first current;

receiving the first current via a diode-connected bipolar junction transistor to generate a detection voltage;

buffering the detection voltage with a buffer circuit to improve the driving capability of the detection voltage; and calculating an operating temperature of the electronic device using a lookup table and the detection voltage, wherein the operating temperature is the operation state.

* * * * *